US006979488B2

(12) United States Patent
Paz-Pujalt et al.

(10) Patent No.: US 6,979,488 B2
(45) Date of Patent: Dec. 27, 2005

(54) RECEIVER HAVING HYDROPHILIC RECEIVING SURFACE

(75) Inventors: Gustavo R. Paz-Pujalt, Rochester, NY (US); David L. Patton, Webster, NY (US); John R. Fredlund, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/131,710

(22) Filed: Aug. 10, 1998

(65) Prior Publication Data

US 2002/0197451 A1 Dec. 26, 2002

(51) Int. Cl.[7] ..... B41M 5/00
(52) U.S. Cl. ..... 428/204; 428/32.24
(58) Field of Search ..... 428/32.24, 195–214, 428/423.1, 424.2; 508/204; 503/227

(56) References Cited

U.S. PATENT DOCUMENTS

| | | | | | |
|---|---|---|---|---|---|
| 4,469,464 | A | | 9/1984 | Capezzuto | |
| 4,503,111 | A | * | 3/1985 | Jaeger et al. | 428/195 |
| 4,642,247 | A | * | 2/1987 | Mouri et al. | 427/214 |
| 4,832,984 | A | * | 5/1989 | Hasegawa et al. | 427/161 |
| RE33,260 | E | | 7/1990 | Stephenson | |
| 5,158,927 | A | * | 10/1992 | Bailey et al. | 503/227 |
| 5,322,832 | A | * | 6/1994 | Takeyama et al. | 503/227 |
| 5,364,732 | A | * | 11/1994 | Mouri et al. | 430/201 |
| 5,369,077 | A | | 11/1994 | Harrison et al. | |
| 5,389,723 | A | * | 2/1995 | Iqbal et al. | 525/57 |
| 5,472,757 | A | | 12/1995 | Ogawa et al. | |
| 5,476,746 | A | | 12/1995 | Janssens et al. | |
| 5,614,464 | A | | 3/1997 | Kung | |
| 5,672,198 | A | | 9/1997 | Belmont | |
| 5,723,211 | A | * | 3/1998 | Romano et al. | 428/32.24 |
| 5,789,070 | A | * | 8/1998 | Shaw-Klein et al. | 428/32.24 |
| 5,984,467 | A | * | 11/1999 | Bodager et al. | 347/101 |
| 6,040,060 | A | * | 3/2000 | Missel et al. | 428/32.24 |
| 6,194,348 | B1 | * | 2/2001 | Onishi et al. | 503/227 |

FOREIGN PATENT DOCUMENTS

| | | |
|---|---|---|
| EP | 0671268 | 8/1994 |
| EP | 0858899 | 8/1998 |

* cited by examiner

*Primary Examiner*—Bruce H. Hess
(74) *Attorney, Agent, or Firm*—Raymond L. Owens

(57) ABSTRACT

A receiver for receiving a water-based colorant image transferred by a stamp or the like, including an image receiving structure having a support; an information receiving layer which contains recorded information, such information receiving layer being formed over the support; and a clear hydrophobic protective layer formed over the information receiving layer; and a hydrophilic layer formed over the information receiving layer and selected so as to be able to receive a water-based colorant image.

3 Claims, 6 Drawing Sheets

RECEIVER HAVING HYDROPHILIC RECEIVING SURFACE

FIELD OF THE INVENTION

The present invention relates to providing a water-based colorant image on a receiver having an information image.

BACKGROUND OF THE INVENTION

Heretofore images of high quality have been produced by thermal printers. In a typical thermal printer an image is formed in three passes. First a colorant patch having color such as yellow is placed in transfer relationship with a receiver and then the colorant patch is heated in a pattern corresponding to the yellow portion of an image to be completed. Thereafter, cyan and magenta portions of the image are formed in a similar fashion. The completed color image on the receiver is continuous tone and in many cases can rival photographic quality.

In one type of thermal printer which prints colored images, a donor contains a repeating series of spaced frames of different colored heat transferable colorants. Thermal colorant transfer printers offer the advantage of true "continuous tone" density transfer. This result is obtained by varying the energy applied to each heating element, yielding a variable density image pixel in the receiver. The donor is disposed between a receiver, such as coated paper, and a print head formed of, for example, a plurality of individual heating resistors. When a particular heating resistor is energized, it produces heat and causes colorant from the donor to transfer to the receiver. The density or darkness of the printed color colorant is a function of the energy delivered from the heating element to the donor.

Under common circumstances after an image is printed, a protective layer of material is coated in order to prevent damage to the image. Commonly-assigned U.S. Pat. No. 5,369,077 teaches that silicone block copolymers are added to the receiver and receiver overcoat to prevent sticking to the colorant patch. Though this effectively protects the image it hurts the ability to affix information carried by a water soluble inks or pigments, for example a rubber stamp mark. Rubber or polymer stamp marks normally consist of water soluble inks or pigments. Images produced using a thermal printing process provide a convenient method for creating images for use as identification, for example as passport and visa pictures and small pictures that are attached to school, job or club applications. When pictures are used for identification purposes, the pictures and the documents to which they are attached may require some type of official stamp. In most cases the stamp is an official seal made of rubber. The rubber stamp is used to apply the official seal to the document and picture. The marking medium is a water soluble ink or pigment that is readily absorbed by the material to which it is applied. In the case of thermal media during the printing process a protective transparent layer is coated that is water resistant thus making the adhesion of a rubber stamp impossible. Commonly-assigned U.S. Pat. No. 5,614,464 teaches the addition of perfluorinated alkyl sulfonamide ester copolymers to improve receiver writeability. This coating on the other hand may help the adherence of water based inks or dyes.

SUMMARY OF THE INVENTION

It is an object of the present invention to produce a surface that will accept information carried in a water-based colorant as is the case of a rubber or polymer stamp.

The object is achieved by: a receiver for receiving a water-based colorant image transferred by a stamp or the like, comprising:

(a) an image receiving structure having:
  (i) a support;
  (ii) an information receiving layer which contains recorded information, such information receiving layer being formed over the support; and
  (iii) a clear hydrophobic protective layer formed over the information receiving layer; and (b) a hydrophilic layer formed over the information receiving layer and selected so as to be able to receive a water-based colorant image.

In a preferred embodiment of this invention the hydrophilic layer is provided by a gelatin or other material with similar surface properties formulated with the appropriate surfactants so that it can adhere to the clear hydrophobic protective layer.

In another embodiment of this invention the hydrophobic protective layer and the hydrophilic layer can be applied from patches on a donor element which also includes patches having colorants for forming the information image.

An advantage of the present invention is that the hydrophilic layer can be formed on a receiver which already has received an information image.

A feature of the invention is that the hydrophilic layer can readily receive water-based colorant images transferred from a rubber stamp.

DETAILED DESCRIPTION OF THE PREFERRED EMBODIMENT

Figure 1:
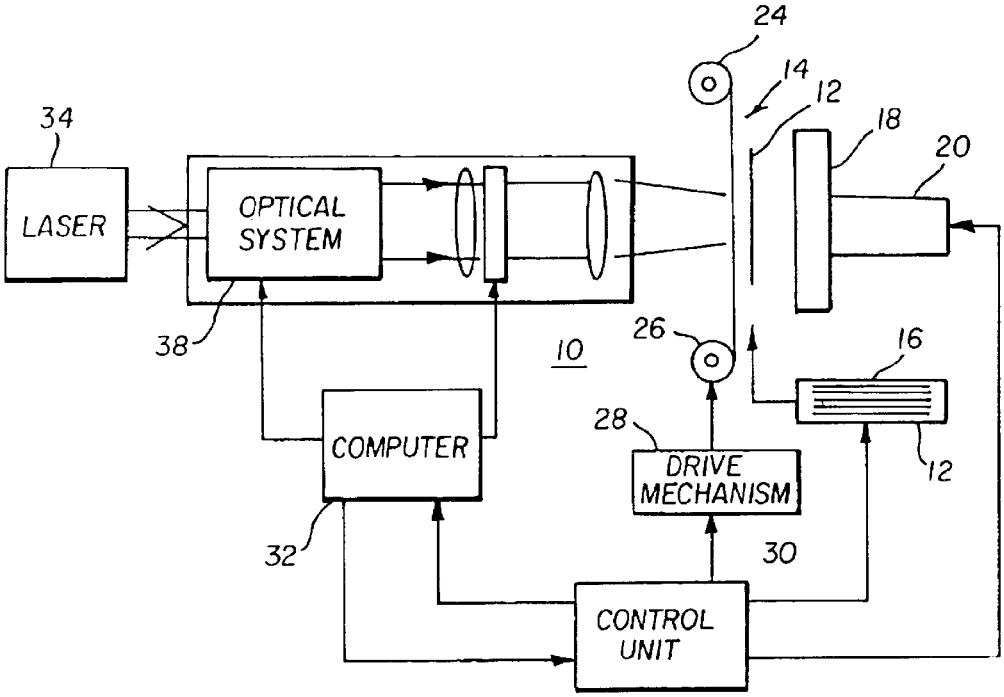
FIG. 1 is a schematic block diagram of a thermal printing apparatus which makes dye images in a receiver in accordance with the present invention.

Referring to FIG. 1 where a thermal printer apparatus 10 employs receivers 12 and a colorant donor element 14 in the form of a web. Receivers 12, in the form of a sheet is serially fed from a tray 16 to a print position by a conventional sheet feeding mechanism, not shown. The thermal printer apparatus 10 uses a colorant donor element 14 which typically employs a colorant that is a dye. Upon heating dye is transferred to a dye receiving element. However, pigments can also be used and the present invention is equally applicable when the printer apparatus is an ink jet printer. Because in any of these situations, a hydrophilic image from a stamp or the like is transferred to a hydrophilic layer as will be described below.

Figure 2:
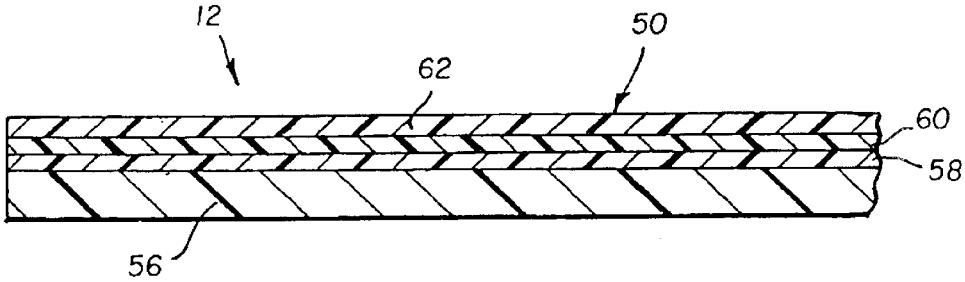
FIG. 2 is a cross-sectional view of a receiver which is used in the apparatus of FIG. 1.

Now referring to FIG. 2, the receiver 12 is comprised of an image receiving structure 50 which includes a support 56. The support 56 can be formed of paper or plastic such as polyethylene terephthlate or polyethylene napthhlate. Alternatively, it can be in the form of a web. Upon each support 56 will be an image receiving layer 60 for receiving colorant from the colorant donor element 14 to form information images. When dye is the colorant a barrier layer 58 is provided to prevent the dye from bleeding into the support 56. In such a situation the image receiving layer 60 is formed on the barrier layer 58.

Figure 3:
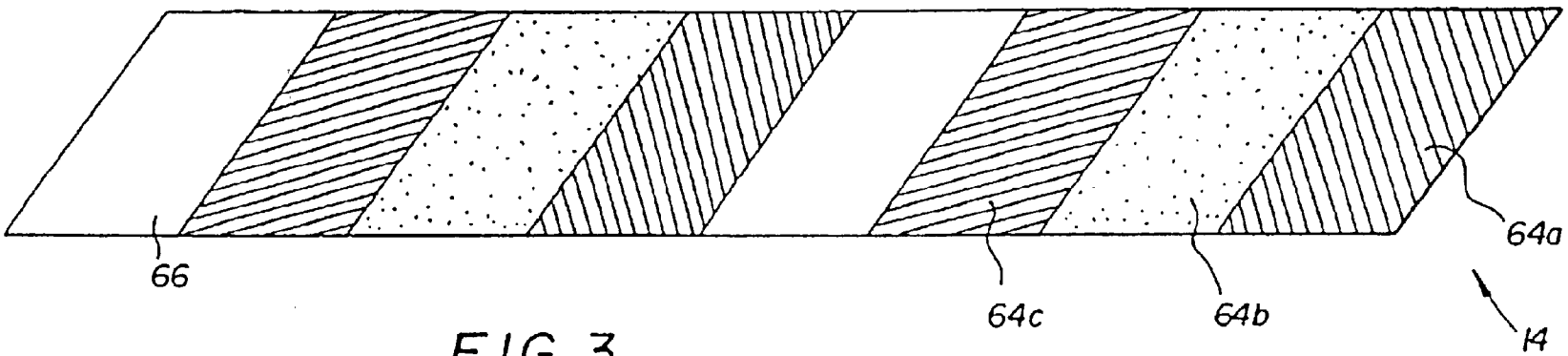
FIG. 3 shows a strip of a typical colorant donor element in web format which can be used by the apparatus shown in FIG. 1.

Referring back to FIG. 1, in operation, a platen 18 is moved into print position by an actuator 20 pressing the receiver 12 against the colorant donor element 14. Actuators are well known in the field and can be provided by a mechanical linkage, solenoid, and small piston arrangement or the like. The colorant donor element 14, shown in FIG. 3 as a web, includes a series of colorant patches. These colorant patches can be cyan, yellow, and magenta 64*a*, 64*b*, 64*c*, respectively, and they are sequentially moved into image transferring relationship with the colorant donor element 14. Each series of colorant patches 64*a–c* is followed by a protective coating patch 66 which is formed of a material that can form a clear hydrophobic protective layer 62.

The colorant donor element 14 is driven along a path from a supply roller 24 onto a take-up roller 26 by a drive mechanism 28 coupled to the take-up roller 26. The drive mechanism 28 includes a stepper motor which incrementally advances and stops the colorant donor element 14 relative to the receiver 12.

A control unit 30 having a microcomputer converts digital signals corresponding to the desired image from a computer 32 to analog signals and sends them as appropriate to the optical system 38 which modulates the laser beam produced by a laser light source 34. The laser light source 34 illuminates the colorant donor element 14 and heats such colorant donor element 14 to cause the transfer of colorant to the image receiving layer 60 of the image receiving structure 50. This process is repeated until an information image is formed on each of the image receiving structures 50. Alternatively, a plurality of donor resistive elements (not shown) which are in contact with the colorant donor element 14. When a donor resistive element is energized it is heated which causes colorant to transfer from the colorant donor element 14 to the receiver 12 in a pattern to provide an information image. For a more complete description of this type of thermal printing apparatus reference is made to commonly assigned U.S. Pat. No. RE 33,260. Of course the process has to be repeated using the cyan, yellow and magenta patches 64*a–c* to complete the information image. An additional pass consists of transferring a clear hydrophobic protective layer 62.

Figure 4:
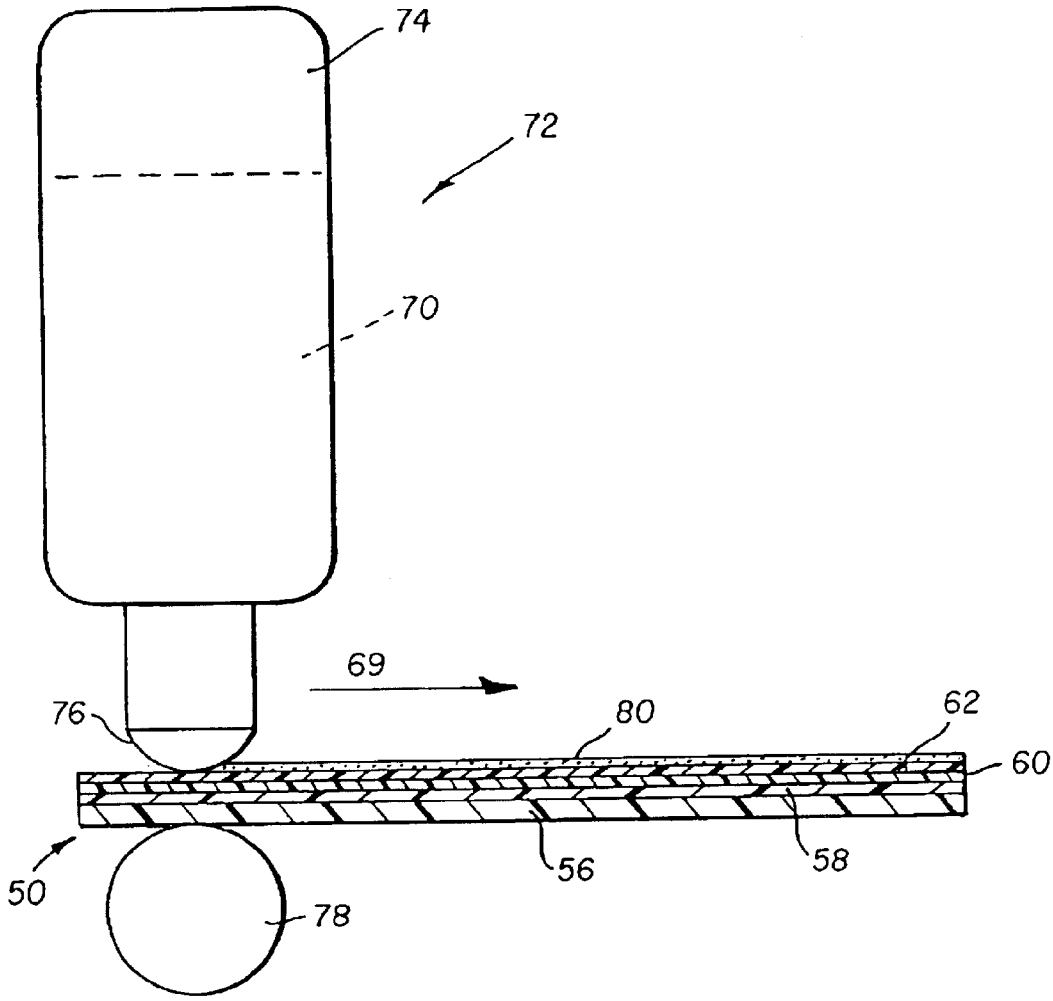
FIG. 4 is a cross-sectional view of a receiver which is used in the apparatus of FIG. 1 showing a thermal printer coating assembly coating a receiver structure of the print.

Now referring to FIG. 4, the image receiving layer 60 of the image receiving structure 50 has received an information image by the transference of the colorant donor element 14 using the thermal printer apparatus 10. After the colorant donor element 14 has formed the information image, the clear hydrophobic protective layer 62 is transferred using the thermal printer apparatus 10. As the image receiving structure 50, exits the thermal printing apparatus 10 in the direction indicated by arrow 69 a hydrophilic mixture 70 such as a layer consisting of gelatin or other material with similar surface properties formulated with the appropriate surfactants such as Alkanol XC, Triton 200 or Aerosol OT is applied to the clear hydrophobic protective layer 62 via an applicator assembly 72 comprised of a reservoir 74, an applicator 76 and a drive mechanism 78 to form a hydrophilic coating 80. The applicator 76 can also apply other materials such as the synthetic polymers to provide the clear hydrophilic layer 80 which are selected from the group consisting of polyvinylpyrollidone (PVP), polyester ionomers, polyethylene oxide and copolymers of vinyl alcohol.

Figure 5:
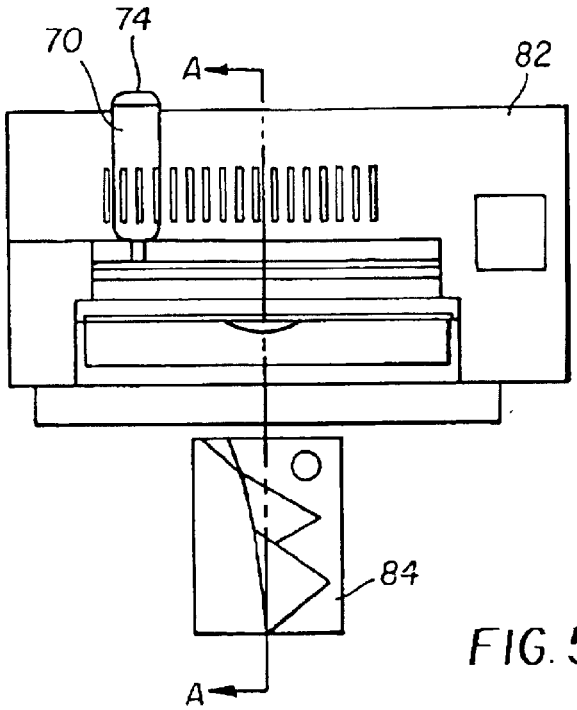
FIG. 5 is a front view of a thermal printer with a coating assembly coating a receiver structure of the print.
Figure 6:
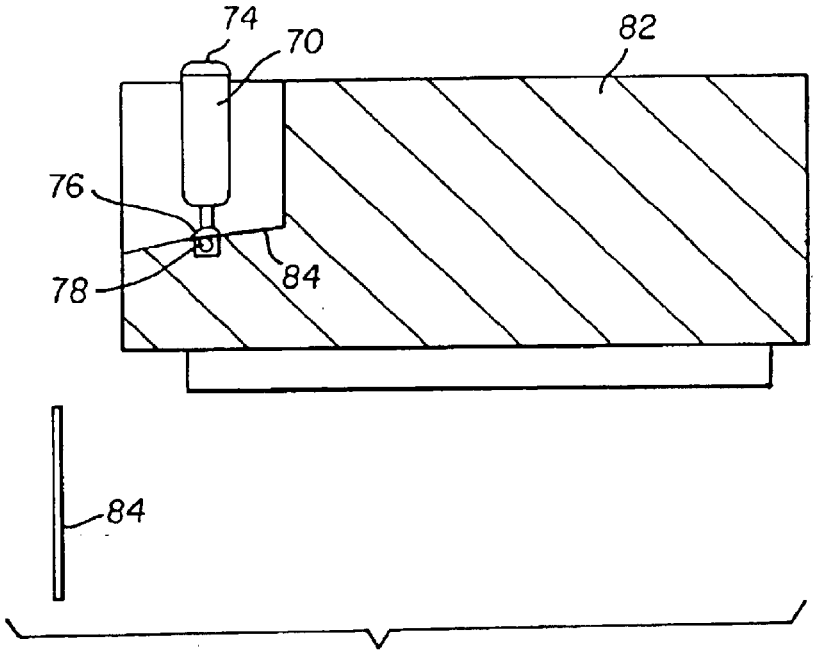
FIG. 6 is a sectional view taken along the lines A—A of FIG. 5.

Now referring to FIGS. 5 and 6 which show portions of a thermal printer 82 is equipped with an applicator assembly 72. As the thermal print 84 exits the thermal printer 82 a hydrophilic mixture 70 including gelatin or other material with similar surface properties formulated with the appropriate surfactants is applied to the thermal print 84 via an applicator 76 and drive mechanism 78. A drive mechanism (not shown) for the thermal printer 82 is used in conjunction with the drive mechanism 78 (see FIG. 4) to drive the thermal print 84 through the applicator 76.

Alternatively, a hydrophilic mixture 70 including gelatin or other material with similar surface properties formulated with the appropriate surfactants is applied to the clear hydrophobic protective layer 62 via an aerosol sprayer to form a hydrophilic coating 80.

Still further in another embodiment, a hydrophilic mixture 70 including gelatin or other material with similar surface properties formulated with the appropriate surfactants is applied to the clear hydrophobic protective layer 62 via a roller to form a hydrophilic coating 80.

Figure 7:
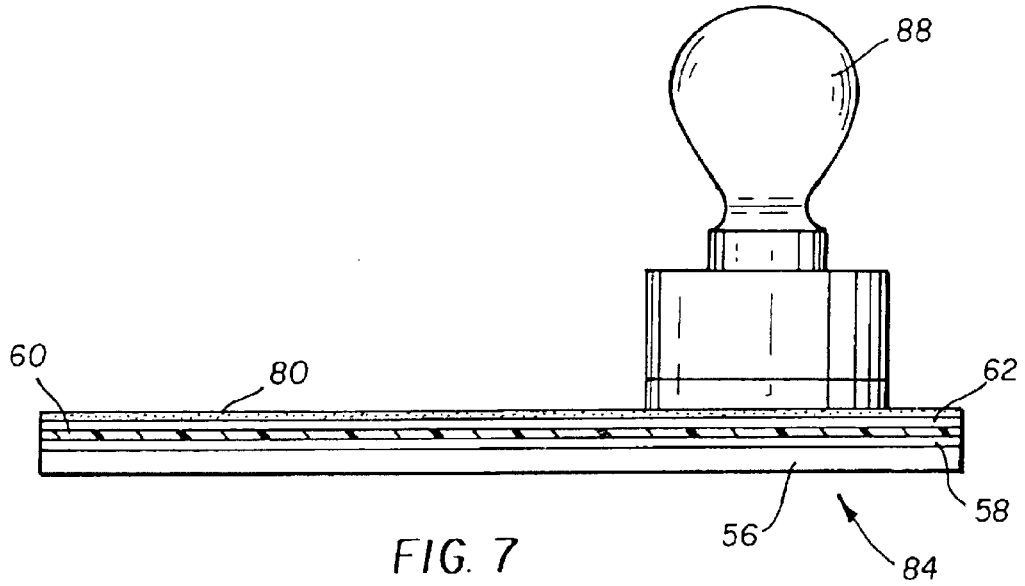
FIG. 7 shows a side view of a rubber stamp applying a stamp image on the surface of the finished print.
Figure 8:
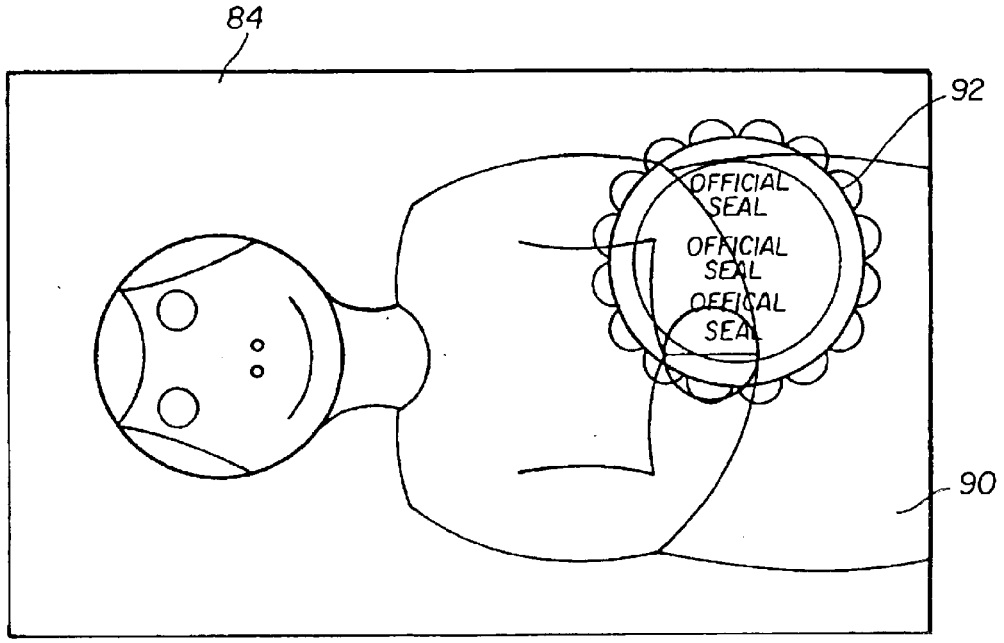
FIG. 8 shows an image that the rubber stamp of FIG. 7 has applied to on the surface of the finished print.

Now referring to FIG. 7, a thermal print 84 is shown in a side view. A hydrophilic coating 80 has been applied to the clear hydrophobic protective layer 62 of the thermal print 84. A rubber stamp 88 is used to apply an official seal 92 to the thermal print 84 as shown in FIG. 8 having an information image 90. The colorants applied by the rubber or polymer stamp 88 should of course be hydrophilic and they can be for example, dyes or pigments. The inks containing these colorants are well known in the art and are described in U.S. Pat. Nos. 5,672,198 and 4,469,464.

Figure 9:
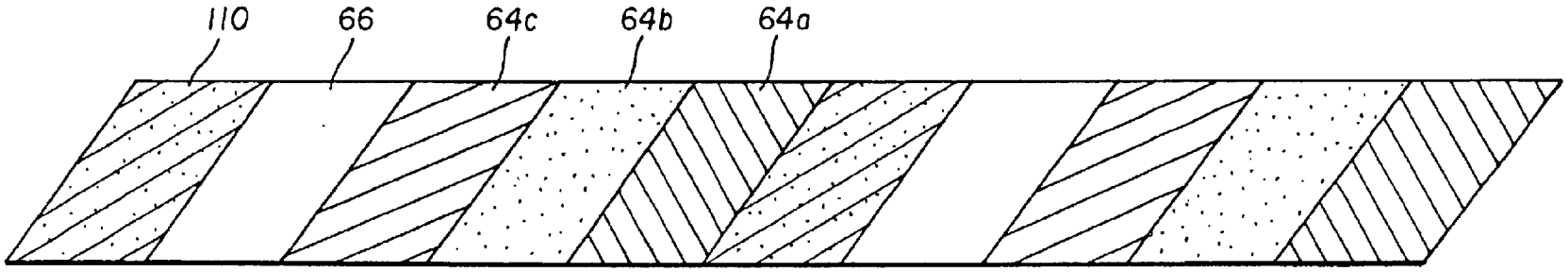
FIG. 9 shows a strip of typical colorant donor element in web format having colorant patches, a clear hydrophobic patches and a clear hydrophilic patch.

In another embodiment the colorant donor element 14, shown in FIG. 9 as a web, includes a series of colorant patches 64*a–c*. These colorant patches can be cyan, yellow, and magenta 64*a*, 64*b*, 64*c*, respectively, and they are sequentially moved into image transferring relationship with the colorant donor element 14. Each series of colorant patches 64*a–c* is followed by a protective coating patch 66 which in turn is followed by a hydrophilic patch 110. An additional pass includes transferring a hydrophilic patch 110. The transferal of the hydrophilic patch 110 creates a clear hydrophilic layer 80 over the clear hydrophobic protective layer 62 of the thermal print 84.

The invention has been described in detail with particular reference to certain preferred embodiments thereof, but it will be understood that variations and modifications can be effected within the spirit and scope of the invention.

PARTS LIST

| | |
|---|---|
| 10 | printer apparatus |
| 12 | receiver |
| 14 | colorant donor element |
| 16 | tray |
| 18 | platen |
| 20 | actuator |

-continued

| PARTS LIST | |
|---|---|
| 24 | supply roller |
| 26 | take-up roller |
| 28 | drive mechanism |
| 30 | control unit |
| 32 | computer |
| 34 | laser light source |
| 38 | optical system |
| 50 | image receiving structure |
| 56 | support |
| 60 | image receiving layer |
| 62 | hydrophobic protective layer |
| 64a | cyan patch |
| 64b | yellow patch |
| 64c | magenta patch |
| 66 | protective coating patch |
| 69 | arrow |
| 70 | hydrophilic mixture |
| 72 | applicator assembly |
| 74 | reservoir |
| 76 | applicator |
| 78 | drive mechanism |
| 80 | hydrophilic coating |
| 82 | thermal printer |
| 84 | thermal print |
| 88 | rubber stamp |
| 90 | information image |
| 110 | hydrophilic patch |

What is claimed is:

1. A receiver for receiving a water-based colorant image transferred by a stamp, comprising:

(a) an image receiving a structure having:

(i) a support;

(ii) a barrier layer formed over the support; and (iii) an information receiving layer which contains recorded information, said information receiving layer being formed over the barrier layer; and (iv) a clear hydrophobic layer formed over the information receiving layer; and (b) a clear hydrophilic layer formed over the information receiving layer for receiving and holding a water-based colorant image transferred by a stamp.

2. The receiver of claim 1 wherein the clear hydrophilic layer includes gelatin formulated with surfactants.

3. The receiver of claim 1 wherein the clear hydrophilic layer includes material selected from the group consisting of polyvinylpyrrolidone (PVP), polyester ionomers, polyethylene oxide and copolymers of vinyl alcohol.

* * * * *